US012649881B2

(12) United States Patent
Koseoglu

(10) Patent No.: US 12,649,881 B2
(45) Date of Patent: Jun. 9, 2026

(54) METHODS FOR HYDROCRACKING HYDROCARBONS

(71) Applicant: Saudi Arabian Oil Company, Dhahran (SA)

(72) Inventor: Omer Refa Koseoglu, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 205 days.

(21) Appl. No.: 18/679,087

(22) Filed: May 30, 2024

(65) Prior Publication Data

US 2025/0368902 A1 Dec. 4, 2025

(51) Int. Cl.

| | |
|---|---|
| ***C10G 47/14*** | (2006.01) |
| ***C10G 47/18*** | (2006.01) |
| ***C10G 47/20*** | (2006.01) |

(52) U.S. Cl.

CPC ..... *C10G 47/18* (2013.01); *C10G 47/20* (2013.01); *C10G 2300/301* (2013.01); *C10G 2300/4081* (2013.01)

(58) Field of Classification Search

CPC ..... C10G 47/00; C10G 47/04; C10G 47/12; C10G 47/14; C10G 47/18; C10G 47/20; C10G 47/36; C10G 2300/301; C10G 2300/4081; B01J 37/00

See application file for complete search history.

(56) References Cited

U.S. PATENT DOCUMENTS

| | | | | |
|---|---|---|---|---|
| 3,424,671 | A * | 1/1969 | Kay | B01J 29/061 208/2 |
| 3,619,407 | A | 11/1971 | Brea et al. | |
| 4,447,315 | A | 5/1984 | Lamb et al. | |
| 4,601,815 | A | 7/1986 | Forester et al. | |
| 4,921,595 | A * | 5/1990 | Gruia | C10G 65/12 208/100 |
| 4,954,242 | A | 9/1990 | Gruia | |
| 7,763,163 | B2 | 7/2010 | Koseoglu | |
| 11,834,615 | B2 | 12/2023 | Koseoglu | |
| 2013/0220885 | A1 * | 8/2013 | Low | C10G 47/02 208/102 |
| 2018/0187100 | A1 | 7/2018 | Koseoglu | |
| 2020/0172818 | A1 * | 6/2020 | Hunter | B01D 3/141 |
| 2021/0130702 | A1 | 5/2021 | Koseoglu | |
| 2021/0179945 | A1 | 6/2021 | Koseoglu | |

* cited by examiner

*Primary Examiner* — In Suk C Bullock
*Assistant Examiner* — Jason Y Chong
(74) *Attorney, Agent, or Firm* — Dinsmore & Shohl LLP

(57) ABSTRACT

Methods for hydrocracking a hydrocarbon feed may include contacting an initial catalyst with a conditioning stream having from 50 ppmw to 5000 ppmw heavy polynuclear aromatic compounds to form a conditioned catalyst. The initial catalyst may include a zeolite, an amorphous silica-alumina, or both. The method includes contacting the conditioned catalyst with the hydrocarbon feed in the presence of hydrogen to crack all or a portion of the hydrocarbon feed to form a hydrocarbon product. The hydrocarbon feed has an initial boiling point greater than or equal to 325° C.

20 Claims, 1 Drawing Sheet

METHODS FOR HYDROCRACKING HYDROCARBONS

TECHNICAL FIELD

Embodiments of the present disclosure generally relate to methods for cracking hydrocarbons, and more specifically, to methods for cracking hydrocarbons using a conditioned catalyst.

BACKGROUND

Hydrocracking processes may be used to split molecules of a hydrocarbon feed into smaller, lighter molecules, which generally have greater average volatility and greater economic value than the hydrocarbon feed. Some hydrocracking catalysts may have greater selectivity for certain products, based on the active sites of the catalyst. For example, some hydrocracking catalysts may be more selective for naphtha than for other products, such as middle distillates. Hydrocracking catalysts may be conditioned before being used in a hydrocracking process to change the selectivity of the catalyst. Accordingly, there is a need for improved methods of hydrocracking hydrocarbon feeds in which the catalyst is conditioned to improve the selectivity of the catalyst for desired products.

SUMMARY

Heavy polynuclear aromatic ("HPNA") compounds may form in hydrocracking processes, and may accumulate in recycle streams of such processes. HPNA compounds are generally considered to be detrimental to hydrocracking catalyst activity and may be removed from the recycle streams or unconverted fractions of the product of the hydrocracking process before such recycle stream is further processed. However, unexpectedly, it has been presently discovered that HPNA compounds may be used to condition hydrocracking catalysts, and that such conditioning may enhance catalytic properties for certain products, such as middle distillates. According to embodiments of methods for hydrocracking hydrocarbon feeds described herein, an initial catalyst may be contacted with a conditioning stream comprising from 50 ppmw to 5000 ppmw HPNA compounds. Without being bound by any theory, it is believed that at least a portion of the HPNA compounds may adsorb onto strong acid sites of the initial catalyst to form a conditioned catalyst, which may improve the selectivity of the conditioned catalyst for middle distillates having an initial boiling point from 170° C. to 220° C. and a final boiling point from 320° C. to 370° C. when the catalyst is used in a hydrocracking process. In some embodiments, the HPNA compounds may come from the hydrocracking process as a recycle stream, such that HPNA compounds are not required to be passed into the system at additional cost. In some embodiments, the HPNA compounds may be provided from a separate hydrocracking process.

According to one or more embodiments, a method for hydrocracking a hydrocarbon feed comprises contacting an initial catalyst with a conditioning stream comprising from 50 ppmw to 5000 ppmw heavy polynuclear aromatic compounds to form a conditioned catalyst. The initial catalyst comprises a zeolite, an amorphous silica-alumina, or both. The method further comprises contacting the conditioned catalyst with the hydrocarbon feed in the presence of hydrogen to crack all or a portion of the hydrocarbon feed to form a hydrocarbon product. The hydrocarbon feed has an initial boiling point greater than or equal to 325° C.

BRIEF DESCRIPTION OF THE DRAWINGS

The following detailed description of specific embodiments of the present disclosure can be best understood when read in conjunction with the following drawings, where like structure is indicated with like reference numerals and in which.

Figure 1:
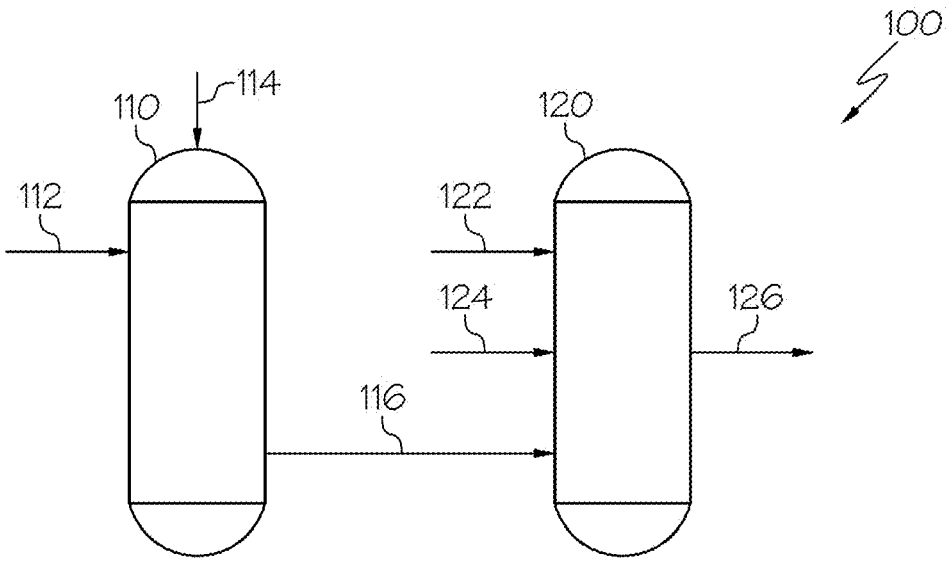
FIG. 1 is a generalized schematic diagram of a hydrocracking system according to one or more embodiments disclosed herein.

For the purpose of describing the simplified schematic illustrations and descriptions of the relevant figures, the numerous valves, temperature sensors, electronic controllers and the like that may be employed and well known to those of ordinary skill in the art of certain chemical processing operations are not included. Further, accompanying components that are often included in typical chemical processing operations, such as air supplies, catalyst hoppers, and flue gas handling systems, are not depicted. Accompanying components that are in hydrocracking units, such as bleed streams, spent catalyst discharge subsystems, and catalyst replacement sub-systems are also not shown. It should be understood that these components are within the spirit and scope of the present embodiments disclosed. However, operational components, such as those described in the present disclosure, may be added to the embodiments described in this disclosure.

It should further be noted that arrows in the drawings refer to process streams. However, the arrows may equivalently refer to transfer lines which may serve to transfer process streams between two or more system components. Additionally, arrows that connect to system components define inlets or outlets in each given system component. The arrow direction corresponds generally with the major direction of movement of the materials of the stream contained within the physical transfer line signified by the arrow. Furthermore, arrows which do not connect two or more system components signify a product stream which exits the depicted system or a system inlet stream which enters the depicted system. Product streams may be further processed in accompanying chemical processing systems or may be commercialized as end products. System inlet streams may be streams transferred from accompanying chemical processing systems or may be non-processed feedstock streams. Some arrows may represent recycle streams, which are effluent streams of system components that are recycled back into the system. However, it should be understood that any represented recycle stream, in some embodiments, may be replaced by a system inlet stream of the same material, and that a portion of a recycle stream may exit the system as a system product.

Additionally, arrows in the drawings may schematically depict process steps of transporting a stream from one system component to another system component. For example, an arrow from one system component pointing to another system component may represent "passing" a system component effluent to another system component, which may include the contents of a process stream "exiting" or being "removed" from one system component and "introducing" the contents of that product stream to another system component.

Arrows shown in dashed line may signify optional streams or steps. However, it should be understood that not all solid lined arrows necessarily signify necessary streams or steps that would be present in all embodiments.

It should be understood that according to the embodiments presented in the relevant figures, an arrow between two system components may signify that the stream is not processed between the two system components. In other embodiments, the stream signified by the arrow may have substantially the same composition throughout its transport between the two system components. Additionally, it should be understood that in one or more embodiments, an arrow may represent that at least 75 wt. %, at least 90 wt. %, at least 95 wt. %, at least 99 wt. %, at least 99.9 wt. %, or even 100 wt. % of the stream is transported between the system components. As such, in some embodiments, less than all of the streams signified by an arrow may be transported between the system components, such as if a slip stream is present.

It should be understood that two or more process streams are "mixed" or "combined" when two or more lines intersect in the schematic flow diagrams of the relevant figures. Mixing or combining may also include mixing by directly introducing both streams into a like reactor, separation device, or other system component. For example, it should be understood that when two streams are depicted as being combined directly prior to entering a separation unit or reactor, that in some embodiments the streams could equivalently be introduced into the separation unit or reactor and be mixed in the reactor. Also, in embodiments where two or more streams are depicted as separately being passed into a system component, they may equally be combined prior to being passed to the system component in a combined stream.

Reference will now be made in greater detail to various embodiments, some embodiments of which are illustrated in the accompanying drawings. Whenever possible, the same reference numerals will be used throughout the drawings to refer to the same or similar parts.

DETAILED DESCRIPTION

Embodiments of the present disclosure are directed to methods for hydrocracking a hydrocarbon feed. The methods for cracking hydrocarbon feeds may include a conditioning step, where an initial catalyst is contacted with a conditioning stream to form a conditioned catalyst, and a hydrocracking step, where the conditioned catalyst is contacted with a hydrocarbon feed in the presence of hydrogen to form a hydrocarbon product. The conditioning stream comprises heavy polynuclear aromatic compounds, which may adsorb onto acid sites of the initial catalyst to form a conditioned catalyst. This may improve the selectivity of the conditioned catalyst for middle distillates. As described herein, "middle distillates" refer to hydrocarbons boiling in the range of about 170° C. to about 370° C.

In one or more embodiments, the method may comprise contacting an initial catalyst with a conditioning stream to form a conditioned catalyst. Referring now to FIG. 1, the initial catalyst 112 may be contacted with the conditioning stream 114. The initial catalyst 112 and the conditioning stream 114 may be contacted in any suitable reactor 110. Contacting the initial catalyst 112 with the conditioning stream 114 may form a conditioned catalyst 116.

The conditioning stream 114 comprises heavy polynuclear aromatic compounds. As described herein, "heavy polynuclear aromatic compounds," also referred to as "HPNA compounds," refer to fused polycyclic aromatic compounds having ten or more rings. For example, HPNA compounds include ovalenes ($C_{32}H_{14}$). The fused polycyclic aromatic structure may also have alkyl groups or naphthenic rings attached to it.

In one or more embodiments, the conditioning stream 114 may comprise from 50 parts per million by weight (ppmw) to 5000 ppmw HPNA compounds. For example the conditioning stream 114 may comprise HPNA compounds in an amount from 50 ppmw to 5000 ppmw, from 100 ppmw to 5000 ppmw, from 500 ppmw to 5000 ppmw, from 1000 ppmw to 5000 ppmw, from 1500 ppmw to 5000 ppmw, from 2000 ppmw to 5000 ppmw, from 2500 ppmw to 5000 ppmw, from 3000 ppmw to 5000 ppmw, from 3500 ppmw to 5000 ppmw, from 4000 ppmw to 5000 ppmw, from 4500 ppmw to 5000 ppmw, from 50 ppmw to 4500 ppmw, from 50 ppmw to 4000 ppmw, from 50 ppmw to 3500 ppmw, from 50 ppmw to 3000 ppmw, from 50 ppmw to 2500 ppmw, from 50 ppmw to 2000 ppmw, from 50 ppmw to 1500 ppmw, from 50 ppmw to 1000 ppmw, from 50 ppmw to 500 ppmw, from 50 ppmw to 100 ppmw, or any range or combination of ranges formed from these endpoints. Without intending to be bound by theory, if the amount of HPNA compounds in the conditioning stream is too low, for example less than 50 ppmw, then the initial catalyst may be conditioned too slowly. Additionally, if the amount of HPNA compounds in the conditioning stream is too great, for example greater than 5000 ppmw, then the initial catalyst may be conditioned too quickly, leading to an undesired loss in catalyst activity.

In one or more embodiments, the conditioning stream 114 may be any suitable hydrocarbon-containing stream that comprises from 50 ppmw to 5000 ppmw HPNA compounds. In some embodiments, the conditioning stream 114 may have an initial boiling point in the range of about 340° C. to about 370° C. and a final boiling point in the range of about 700° C. to 750° C. In some embodiments, the conditioning stream 114 may have an initial boiling point of 340° C., 350° C., 360° C., or 370° C. and a final boiling point of 700° C., 710° C., 720° C., 730° C., 740° C., or 750° C., or any ranges or combinations of ranges formed from these endpoints.

The initial catalyst 112 may be any catalyst that is suitable for use in hydrocracking processes. In one or more embodiments, the initial catalyst 112 may comprise an active metal component on a support. In some hydrocracking catalysts, the support may include a zeolite or an amorphous silica-alumina. According to one or more embodiments, the initial catalyst may comprise a zeolite, or an amorphous silica-alumina, or both. In some embodiments, the initial catalyst may comprise a zeolite or a plurality of zeolites. The zeolite may be any suitable zeolite. For example, the initial catalyst may comprise a zeolite having a FAU framework, an MFI framework, a BEA framework, or a MOR framework.

Both the zeolites and the amorphous silica-alumina may comprise acid sites. In one or more embodiments, the initial catalyst 112 may comprise acid sites in an amount from 0.025 mmol/g to 5 mmol/g. For example, the initial catalyst may comprise acid sites in an amount from 0.025 mmol/g to 5 mmol/g, from 0.05 mmol/g to 5 mmol/g, 0.1 mmol/g to 5 mmol/g, 0.5 mmol/g to 5 mmol/g, 1 mmol/g to 5 mmol/g, 1.5 mmol/g to 5 mmol/g, 2 mmol/g to 5 mmol/g, 2.5 mmol/g to 5 mmol/g, 3 mmol/g to 5 mmol/g, 3.5 mmol/g to 5 mmol/g, 4 mmol/g to 5 mmol/g, 4.5 mmol/g to 5 mmol/g, 0.025 mmol/g to 4.5 mmol/g, 0.025 mmol/g to 4 mmol/g, 0.025 mmol/g to 3.5 mmol/g, 0.025 mmol/g to 3 mmol/g, 0.025 mmol/g to 2.5 mmol/g, 0.025 mmol/g to 2 mmol/g, 0.025 mmol/g to 1.5 mmol/g, 0.025 mmol/g to 1 mmol/g, 0.025 mmol/g to 0.5 mmol/g, 0.025 mmol/g to 0.1 mmol/g, 0.025 mmol/g to 0.05 mmol/g, or any range or combination of ranges formed from these endpoints. The amount of acid sites may be measured by ammonia temperature-programmed desorption ($NH_3$-TPD) analysis to determine the moles of the base ammonia molecule adsorption onto the acid sites. Without intending to be bound by theory, these acid sites may affect the selectivity of the catalyst for certain products, such middle distillates, when the catalyst is used in hydrocracking processes.

When the initial catalyst 112 is contacted with the conditioning stream, at least a portion of the HPNA compounds from the conditioning stream may adsorb onto the acid sites of the initial catalyst to form the conditioned catalyst. In one or more embodiments, the HPNA compounds may adsorb onto from 1% to 10% of the acid sites of the initial catalyst 112 during formation of the conditioned catalyst 116. For example, the HPNA compounds may adsorb onto from 1% to 10%, 2% to 10%, 3% to 10%, 4% to 10%, 5% to 10%, 6% to 10%, 7% to 10%, 8% to 10%, 9% to 10%, 1% to 9%, 1% to 8%, 1% to 7%, 1% to 6%, 1% to 5%, 1% to 4%, 1% to 3%, 1% to 2%, of the acid sites of the initial catalyst 112, or any range or combination of ranges formed from these endpoints. Without intending to be bound by theory, the conditioned catalyst may have an improved selectivity for middle distillates relative to the initial catalyst because the reduction in acid sites may prevent the over-cracking of middle distillates to lighter products, such as naphtha.

In one or more embodiments, the initial catalyst 112 may comprise one or more active metal components of metals or metal compounds (oxides or sulfides) selected from the Periodic Table of the Elements IUPAC Groups 6, 7, 8, 9 and 10. The active metal components are typically deposited or otherwise incorporated on the one or more zeolites and/or the amorphous silica-alumina of the initial catalyst 112. In some embodiments, the initial catalyst 112 may comprise one or more of palladium, platinum, nickel, molybdenum, cobalt, and tungsten.

The initial catalyst 112 and the conditioning stream 114 may be contacted in any suitable reactor 110. In one or more embodiments, contacting the initial catalyst 112 and the conditioning stream 114 may occur at a temperature of from 300° C. to 450° C. For example, contacting the initial catalyst 112 and the conditioning stream 114 may occur at a temperature of from 300° C. to 450° C., from 310° C. to 450° C., from 320° C. to 450° C., from 330° C. to 450° C., from 340° C. to 350° C., from 350° C. to 450° C., from 360° C. to 450° C., from 370° C. to 450° C., from 380° C. to 450° C., from 390° C. to 450° C., from 400° C. to 450° C., from 410° C. to 450° C., from 420° C. to 450° C., from 430° C. to 450° C., from 440° C. to 450° C., from 300° C. to 440° C., from 300° C. to 430° C., from 300° C. to 420° C., from 300° C. to 410° C., from 300° C. to 400° C., from 300° C. to 390° C., from 300° C. to 380° C., from 300° C. to 370° C., from 300° C. to 360° C., from 300° C. to 350° C., from 300° C. to 340° C., from 300° C. to 330° C., from 300° C. to 320° C., from 300° C. to 310° C., or any range or combination of ranges formed from these endpoints.

In one or more embodiments, contacting the initial catalyst 112 and the conditioning stream 114 may occur at a pressure from 40 bar to 200 bar. For example, contacting the initial catalyst 112 and the conditioning stream 114 may occur at a pressure from 40 bar to 200 bar, from 50 bar to 200 bar, from 75 bar to 200 bar, from 100 bar to 200 bar, from 125 bar to 200 bar, from 150 bar to 200 bar, from 175 bar to 200 bar, from 40 bar to 175 bar, from 40 bar to 150 bar, from 40 bar to 125 bar, from 40 bar to 100 bar, from 40 bar to 75 bar, or any range or combination of ranges formed from these endpoints.

In one or more embodiments, the initial catalyst 112 and the conditioning stream 114 may be contacted in a reactor 110 at a liquid hourly space velocity from 0.1 $h^{-1}$ to 10 $h^{-1}$. As described herein, "liquid hourly space velocity" refers to the liquid volume flow per hour divided by the volume of the catalyst. For example the initial catalyst 112 and the conditioning stream 114 may be contacted in a reactor 110 at a liquid hourly space velocity from 0.1 $h^{-1}$ to 10 $h^{-1}$, from 0.5 h 1 to 10 $h^{-1}$, from 1 $h^{-1}$ to 10 $h^{-1}$, from 2 $h^{-1}$ to 10 $h^{-1}$, from 3 $h^{-1}$ to 10 $h^{-1}$, from 4 $h^{-1}$ to 10 $h^{-1}$, from 5 $h^{-1}$ to 10 $h^{-1}$, from 6 $h^{-1}$ to 10 $h^{-1}$, from 7 $h^{-1}$ to 10 $h^{-1}$, from 8 $h^{-1}$ to 10 $h^{-1}$, from 9 $h^{-1}$ to 10 $h^{-1}$, from 0.1 $h^{-1}$ to 9 $h^{-1}$, from 0.1 $h^{-1}$ to 8 $h^{-1}$, from 0.1 $h^{-1}$ to 7 $h^{-1}$, from 0.1 $h^{-1}$ to 6 $h^{-1}$, from 0.1 $h^{-1}$ to 5 $h^{-1}$, from 0.1 $h^{-1}$ to 4 $h^{-1}$, from 0.1 $h^{-1}$ to 3 $h^{-1}$, from 0.1 $h^{-1}$ to 2 $h^{-1}$, from 0.1 $h^{-1}$ to 1 $h^{-1}$, from 0.1 $h^{-1}$ to 0.5 $h^{-1}$, or any range or combination of ranges formed from these endpoints.

As described hereinabove, contacting the initial catalyst 112 with the conditioning stream 114 may result in at least a portion of the HPNA compounds adsorbing onto acid sites of the initial catalyst 112. This may improve the selectivity of the conditioned catalyst 116 for certain products, such as middle distillates, when the conditioned catalyst 116 is used in a hydrocracking process. However, the adsorption of HPNA onto the acid sites of the initial catalyst 112 may also reduce the activity of the conditioned catalyst 116 relative to the activity of the initial catalyst 112. Without intending to be bound by theory, the selectivity of the initial catalyst 112 for middle distillates may be improved at the expense of catalyst activity.

In one or more embodiments, the activity of the conditioned catalyst 116 may be at least 1° C. less than the activity of the initial catalyst 112. For example, the activity of the conditioned catalyst 116 may be at least 1° C., 2° C., 3° C., 4° C., 5° C., 6° C., 7° C., 8° C., 9° C., or even at least 10° C. less than the activity of the initial catalyst 112. As used herein, "activity" refers to a relative activity of the conditioned catalyst and the initial catalyst. The difference in catalyst activity in degrees Celsius refers to the difference in reaction temperature necessary to achieve the same total conversion. For example, when the conditioned catalyst 116 has an activity of 5° C. less than the activity of the initial catalyst 112, the conditioned catalyst 116 will achieve the same conversion as the initial catalyst 112 at a reaction temperature 5° C. greater than the reaction temperature used for the initial catalyst 112.

In one or more embodiments, the activity of the conditioned catalyst 116 may be reduced at a rate of 0.1° C. to 2° C. per day per 100 ppmw of HPNA compounds in the conditioning stream 114, relative to the initial catalyst 112, during the contacting of the initial catalyst 112 with the conditioning stream 114. For example, the activity of the conditioned catalyst 116 may be reduced at a rate of 0.1° C. to 2° C., 0.3° C. to 2° C., 0.5° C. to 2° C., 0.7° C. to 2° C., 0.9° C. to 2° C., 1.1° C. to 2° C., 1.3° C. to 2° C., 1.5° C. to 2° C., 1.7° C. to 2° C., 1.9° C. to 2° C., 0.1° C. to 1.8° C., 0.1° C. to 1.6° C., 0.1° C. to 1.4° C., 0.1° C. to 1.2° C., 0.1° C. to 1.0° C., 0.1° C. to 0.8° C., 0.1° C. to 0.6° C., 0.1° C. to 0.4° C., or 0.1° C. to 0.2° C., per day per 100 ppmw of HPNA compounds in the conditioning stream 114, or any range or combination of ranges formed from these endpoints. In some embodiments, the activity of the conditioned catalyst 116 may be reduced at a rate of 0.3° C. to 1.0° C. per day per 100 ppmw of HPNA compounds in the conditioning stream 114. Without intending to be bound by theory, the rate of catalyst deactivation is a function of the concentration of HPNA in the conditioning stream 114. In typical hydrocracking processes, where the amount of HPNA compounds in the hydrocarbon feed is less than 50 ppmw, the rate of catalyst deactivation is about 1° C. to about 1.5° C. per month, which is about 0.03° C. to 0.05° C. per day. In the conditioning process described herein, where the amount of HPNA compounds in the conditioning stream is from 50 ppmw to 5000 ppmw, the adsorption of HPNA compounds onto the catalyst results in a significantly increased rate of catalyst deactivation, from 0.1° C. to 2° C. per day per 100 ppmw of HPNA compounds in the conditioning stream 114.

Embodiments of the methods for hydrocracking a hydrocarbon feed described herein may comprise contacting the conditioned catalyst with the hydrocarbon feed in the presence of hydrogen to crack all or a portion of the hydrocarbon feed to form a hydrocarbon product. Referring still to FIG. 1, the hydrocarbon feed 122 may contact the conditioned catalyst 116 in any suitable reactor 120. In some embodiments, not depicted, the hydrocarbon feed may contact the conditioned catalyst in the same reactor in which the initial catalyst is conditioned. Referring again to FIG. 1, in some embodiments, the conditioned catalyst 116 may be passed to a second reactor 120 in which the conditioned catalyst 116 is contacted with the hydrocarbon feed 122 in the presence of hydrogen 124. In one or more embodiments, the hydrocarbon feed 122 does not contact the initial catalyst 112 or the conditioned catalyst 116 during the contacting of the initial catalyst 112 with the conditioning stream 114 to form the conditioned catalyst 116. In such embodiments, the conditioning step and the hydrocracking step are separate process steps.

In one or more embodiments, the hydrocarbon feed 122 may have an initial boiling point greater than or equal to 325° C. For example, hydrocarbon feed 122 may have an initial boiling point greater than or equal to 325° C., 330° C., 340° C., 350° C., 360° C., 370° C., 380° C., 390° C. or 400° C. In some embodiments, the hydrocarbon feed 122 may have a final boiling point of 800° C., 700° C., 600° C., or even 565° C. In some embodiments, the hydrocarbon feed 122 may have an initial boiling point of from 325° C. to 400° C. and a final boiling point from 565° C. to 800° C. The hydrocarbon feed 122 may be obtained from any suitable source, such as straight run vacuum gas oil, treated vacuum gas oil, demetallized oil from solvent demetallizing operations, deasphalted oil from solvent deasphalting operations, coker gas oils from coker operations, cycle oils from fluid catalytic cracking operations including heavy cycle oil, and visbroken oils from visbreaking operations, or mixtures of any of these.

In one or more embodiments, the hydrocarbon feed 122 may comprise less than 50 ppmw HPNA compounds. For example, the hydrocarbon feed 122 may comprise less than 50 ppmw, less than 40 ppmw, less than 30 ppmw, or even less than 20 ppmw HPNA compounds. In some embodiments, the hydrocarbon feed 122 may be free or substantially free of HPNA compounds. Without intending to be bound by theory, a hydrocarbon feed comprising less than 50 ppmw HPNA compounds may reduce the rate at which the conditioned catalyst is deactivated during the hydrocracking reaction.

In one or more embodiments, contacting the conditioned catalyst 116 with the hydrocarbon feed 122 in the presence of hydrogen 124 may occur at a temperature from 300° C. to 450° C. For example, contacting the conditioned catalyst 116 with the hydrocarbon feed 122 in the presence of hydrogen 124 may occur at a temperature from 300° C. to 450° C., from 310° C. to 450° C., from 320° C. to 450° C., from 330° C. to 450° C., from 340° C. to 350° C., from 350° C. to 450° C., from 360° C. to 450° C., from 370° C. to 450° C., from 380° C. to 450° C., from 390° C. to 450° C., from 400° C. to 450° C., from 410° C. to 450° C., from 420° C. to 450° C., from 430° C. to 450° C., from 440° C. to 450° C., from 300° C. to 440° C., from 300° C. to 430° C., from 300° C. to 420° C., from 300° C. to 410° C., from 300° C. to 400° C., from 300° C. to 390° C., from 300° C. to 380° C., from 300° C. to 370° C., from 300° C. to 360° C., from 300° C. to 350° C., from 300° C. to 340° C., from 300° C. to 330° C., from 300° C. to 320° C., from 300° C. to 310° C., or any range or combination of ranges formed from these endpoints.

In one or more embodiments, contacting the conditioned catalyst 116 with the hydrocarbon feed 122 in the presence of hydrogen 124 may occur at a pressure from 40 bar to 200 bar. For example, contacting the conditioned catalyst 116 with the hydrocarbon feed 122 in the presence of hydrogen 124 may occur at a pressure from 40 bar to 200 bar, from 50 bar to 200 bar, from 75 bar to 200 bar, from 100 bar to 200 bar, from 125 bar to 200 bar, from 150 bar to 200 bar, from 175 bar to 200 bar, from 40 bar to 175 bar, from 40 bar to 150 bar, from 40 bar to 125 bar, from 40 bar to 100 bar, from 40 bar to 75 bar, or any range or combination of ranges formed from these endpoints.

According to some embodiments, contacting the conditioned catalyst 116 with the hydrocarbon feed 122 in the presence of hydrogen 124 may occur in a reactor 120 at a liquid hourly space velocity from 0.1 $h^{-1}$ to 10 $h^{-1}$. For example, contacting the conditioned catalyst 116 with the hydrocarbon feed 122 in the presence of hydrogen 124 may occur in a reactor 120 at a liquid hourly space velocity from 0.1 $h^{-1}$ to 10 $h^{-1}$, from 0.5 $h^{-1}$ to 10 $h^{-1}$, from 1 $h^{-1}$ to 10 $h^{-1}$, from 2 $h^{-1}$ to 10 $h^{-1}$, from 3 $h^{-1}$ to 10 $h^{-1}$, from 4 $h^{-1}$ to 10 $h^{-1}$, from 5 $h^{-1}$ to 10 $h^{-1}$, from 6 $h^{-1}$ to 10 $h^{-1}$, from 7 $h^{-1}$ to 10 $h^{-1}$, from 8 $h^{-1}$ to 10 $h^{-1}$, from 9 $h^{-1}$ to 10 $h^{-1}$, from 0.1 $h^{-1}$ to 9 $h^{-1}$, from 0.1 $h^{-1}$ to 8 $h^{-1}$, from 0.1 $h^{-1}$ to 7 $h^{-1}$, from 0.1 $h^{-1}$ to 6 $h^{-1}$, from 0.1 $h^{-1}$ to 5 $h^{-1}$, from 0.1 $h^{-1}$ to 4 $h^{-1}$, from 0.1 $h^{-1}$ to 3 $h^{-1}$, from 0.1 $h^{-1}$ to 2 $h^{-1}$, from 0.1 $h^{-1}$ to 1 $h^{-1}$, from 0.1 $h^{-1}$ to 0.5 $h^{-1}$, or any range or combination of ranges formed from these endpoints.

In one or more embodiments, a ratio of hydrogen 124 to hydrocarbon feed 122 may be from 500 to 2500 standard liters of hydrogen per liter of hydrocarbon feed. For example, the ratio of hydrogen 124 to hydrocarbon feed 122 may be from 500 to 2500, from 750 to 2500, from 1000 to 2500, from 1250 to 2500, from 1500 to 2500, from 1750 to 2500, from 2000 to 2500, from 2250 to 2500, from 500 to 2250, from 500 to 2000, from 500 to 1750, from 500 to 1500, from 500 to 1250, from 500 to 1000, or from 500 to 750 standard liters of hydrogen per liter of hydrocarbon feed, or any range or combination of ranges formed from these endpoints. As described herein, a "standard liter of hydrogen" refers to a liter of hydrogen at standard temperature and pressure, 0° C. at 100 kPa (1 bar).

The hydrocarbon product 126 may comprise middle distillates having an initial boiling point of 170° C. to 220° C. and a final boiling point of 320° C. to 370° C. In one or more embodiments, from 50 vol. % to 80 vol. % of the hydrocarbon product 126 may boil at a temperature from 170° C. to 370° C. For example, the amount of the hydrocarbon product 126 that boils at a temperature from 170° C. to 370° C. may be from 50 vol. % to 80 vol. %, from 55 vol. % to 80 vol. %, from 60 vol. % to 80 vol. %, from 65 vol. % to 80 vol. %, from 70 vol. % to 80 vol. %, from 75 vol. % to 80 vol. %, from 50 vol. % to 75 vol. %, from 50 vol. % to 70 vol. %, from 50 vol. % to 65 vol. %, from 50 vol. % to 60 vol. %, from 50 vol. % to 55 vol. %, or any range or combination of ranges formed from these endpoints.

The hydrocarbon product 126 may comprise other fractions of hydrocarbons. For example, the hydrocarbon product 126 may comprise naphtha, having an initial boiling point of about 20° C. and a final boiling point of about 220° C. The hydrocarbon product 126 may comprise lighter hydrocarbons ($C_1$-$C_4$ hydrocarbons) and other gases such as $H_2$, $H_2S$, and $NH_3$. In one or more embodiments, the hydrocarbon product 126 may comprise hydrocarbons having a boiling point greater than 340° C. In some embodiments, the hydrocarbon product 126 may comprise HPNA compounds.

Figure 2:
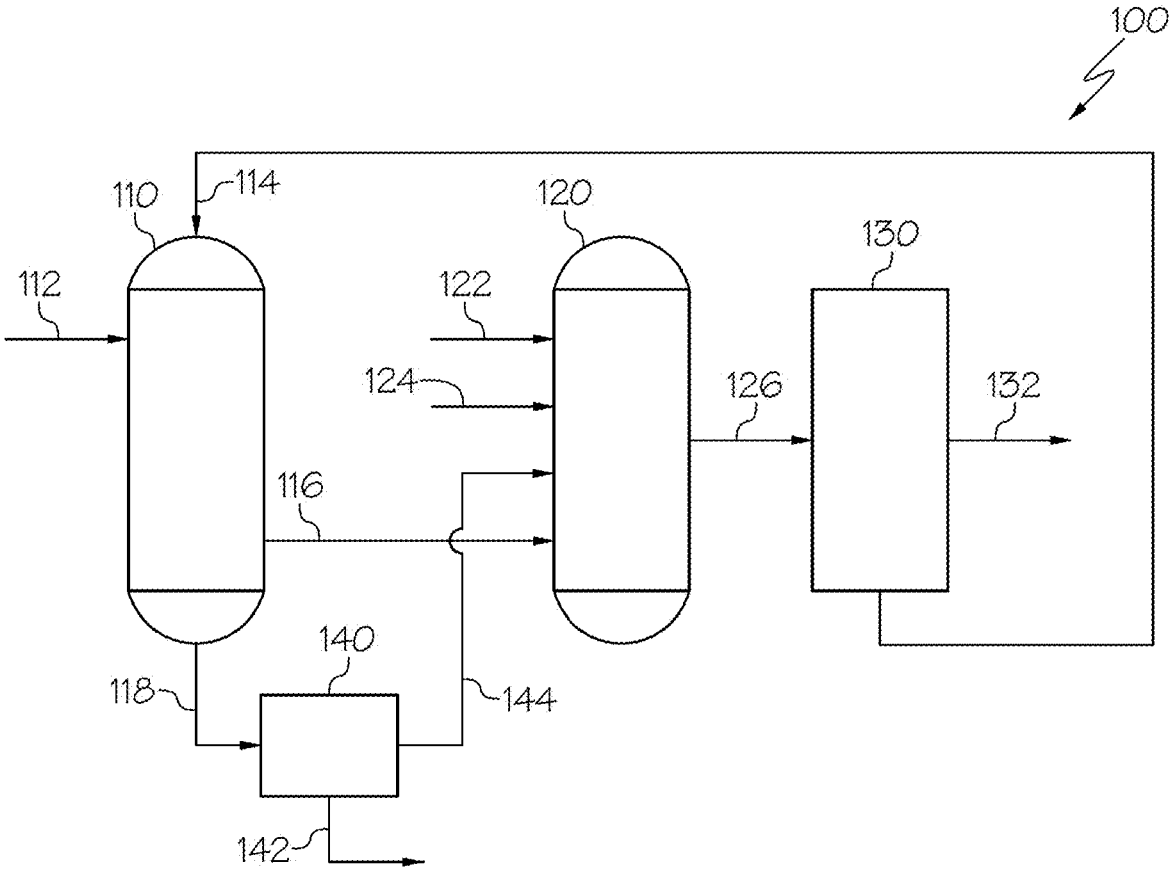
FIG. 2 a generalized schematic diagram of a hydrocracking system including a recycle according to one or more embodiments disclosed herein.

Referring now to FIG. 2, in one or more embodiments, the hydrocarbon product 126 may be separated into at least a first stream 132 and the conditioning stream 114. The hydrocarbon product 126 may be separated in separator 130. The separator 130 may be suitable separator or separation system. For example, the separator 130 may comprise one or more distillation columns for separating the hydrocarbon product 126 into multiple fractions.

In one or more embodiments, the first stream 132 may have an initial boiling point from 170° C. to 220° C. and a final boiling point from 320° C. to 370° C. For example, the first stream 132 may have an initial boiling point from 170° C. to 220° C., from 180° C. to 220° C., from 190° C. to 220° C., from 200° C. to 220° C., from 210° C. to 220° C., from 170° C. to 210° C., from 170° C. to 200° C., from 170° C. to 190° C., from 170° C. to 180° C., or any range or combination of ranges formed from these endpoints. The first stream 132 may have a final boiling point from 320° C. to 370° C., from 330° C. to 370° C., from 340° C. to 370° C., from 350° C. to 370° C., from 360° C. to 370° C., from 320° C. to 360° C., from 320° C. to 350° C., from 320° C. to 340° C., from 320° C. to 330° C., or any range or combination of ranges formed from these endpoints. In such embodiments, the first stream 132 may comprise the middle distillates formed by hydrocracking the hydrocarbon feed 122.

The conditioning stream 114 has the same properties as the conditioning stream 114 described hereinabove. In one or more embodiments, the entirety of the conditioning stream may be passed to the reactor 110 to be contacted with the initial catalyst 112. In some embodiments, a portion of the conditioning stream 114 exiting the separator 130 may be passed to the reactor 110 to be contacted with the initial catalyst. One or more additional streams, which are not depicted in FIG. 2, may also exit the separator 130. In some embodiments, a stream comprising naphtha may exit the separator 130. Additionally, a stream comprising light, $C_1$-$C_4$ hydrocarbons and other gasses present in the hydrocarbon product 126 may exit the separator 130.

Still referring to FIG. 2, in one or more embodiments, after contacting the initial catalyst 112 with the conditioning stream 114, at least a portion of the HPNA compounds may be removed from the conditioning stream 118 to form a recycle stream 144. The HPNA compounds may be removed from the conditioning stream 118 in any suitable system 140 for removing HPNA compounds. Examples of systems and processes for removing HPNA compounds from hydrocracking recycles streams are described in detail in U.S. Patent Application No. 2018/0187100 and U.S. Patent Application No. US 2021/0130702, the entire contents of which are incorporated by reference herein.

In one or more embodiments, the recycle stream 144 may be passed to the reactor 120. The recycle stream 144 may be contacted with the conditioned catalyst 116 and the hydrocarbon feed 122 in the presence of hydrogen 124 to crack all or a portion of the recycle stream 144. As shown in FIG. 2, the recycle stream 144 and the hydrocarbon feed 122 may be separately passed to the reactor 120. It should be understood that contacting the recycle stream 144 with the conditioned catalyst 116 and the hydrocarbon feed 122 may, in some embodiments, include mixing the recycle stream 144 and the hydrocarbon feed 122 upstream of the reactor 120 and passing a mixed stream into the reactor 120 such that the recycle stream 144 and the hydrocarbon feed 122 contact the conditioned catalyst 116 in the reactor 120. In some embodiments, the recycle stream 144 may be free or substantially free of HPNA compounds. For example, the recycle stream 144 may comprise less than 50 ppmw, 40 ppmw, 30 ppmw, 20 ppmw, or even 10 ppmw, HPNA compounds. Without intending to be bound by theory, when the recycle stream 144 comprises less than 50 ppmw HPNA compounds, the rate at which the conditioned catalyst is deactivated during the hydrocracking reaction may be reduced.

EXAMPLES

The following examples illustrate one or more additional features of the present disclosure. The examples are illustrative in nature and should not be understood to limit the subject matter of the present disclosure.

Example 1—Hydrocracking a Hydrocarbon Feed

A hydrocarbon feed was formed by mixing light and heavy vacuum gas oils. The volume ratio of light vacuum gas oil to heavy vacuum gas oil was 25:75. The properties of the hydrocarbon feed are given in Table 1.

TABLE 1

Hydrocarbon Feed Properties

| Property | Unit | Value |
|---|---|---|
| Density @ 15.6° C. | g/cc | 0.87 |
| Sulfur | wt % | 2.07 |
| Nitrogen ASTM D-4629 | ppmw | 1154 |
| Simulated Distillation D2887 | | |
| 0 W % | ° C. | 334 |
| 5 W % | ° C. | 375 |
| 10 W % | ° C. | 389 |
| 30 W % | ° C. | 424 |
| 50 W % | ° C. | 453 |
| 70 W % | ° C. | 488 |
| 90 W % | ° C. | 535 |
| 95 W % | ° C. | 553 |
| 100 W % | ° C. | 587 |

The hydrocarbon feed was hydrocracked under the following conditions. The hydrogen partial pressure was 135 bars. The liquid hourly space velocity was 1.6 $h^{-1}$. The hydrogen to oil ratio was 864 standard liters of hydrogen per liter of oil. The catalyst was a zeolite containing hydrocracking catalyst comprising nickel and molybdenum as the active phase metals. The hydrocracking reaction was performed at four different temperatures, 370° C., 380° C., 390° C. and 400° C. The operating conditions, process performance, and product yields are given in Table 2.

TABLE 2

| Operating Conditions, Process Performance, and Product Yields | | | | |
|---|---|---|---|---|
| Operating Conditions | Reaction 1 | Reaction 2 | Reaction 3 | Reaction 4 |
| Hydrogen Pressure, $Kg/cm^2$ | 135 | 135 | 135 | 135 |
| Temperature, ° C. | 370 | 380 | 390 | 400 |
| Hydrogen/Oil, St. Lt/Lt | 864 | 864 | 865 | 889 |
| LHSV, $h^{-1}$ | 1.600 | 1.599 | 1.598 | 1.555 |
| Process Performance | | | | |
| Conversion, wt. % | 28.8 | 34.7 | 45.6 | 58.7 |
| HDS, wt. % | 99.6 | 99.9 | 100.0 | 99.9 |
| HDN, wt. % | 99.8 | 99.9 | 99.9 | 99.8 |
| Yields | | | | |
| Gas, wt. % | 0.49 | 0.85 | 1.66 | 2.62 |
| Naphtha, wt. % | 2.99 | 4.51 | 9.04 | 13.25 |
| Mid-Distillates, wt. % | 24.11 | 28.38 | 34.34 | 41.90 |
| UCO, wt. % | 72.41 | 66.26 | 54.96 | 42.22 |
| Total | 100.00 | 100.00 | 100.00 | 100.00 |

As shown in Table 2, the hydrodesulfurization (HDS) and hydrodenitrogenation (HDN) levels were greater than 99 wt. %, indicating that the catalyst was effective in removing most of the sulfur and nitrogen. In each of the reactions, the conversion of the fraction boiling at a temperature of greater than 370° C. was from 28.8 wt. % at a reaction temperature of 370° C. to 58.7 wt. % at a reaction temperature of 400° C. As the temperature of the hydrocracking process increased, the yield of naphtha increased. Additionally, the ratio of naphtha to middle distillates also increases. Specifically, when the reaction temperature was 370° C., the yield of naphtha was 2.99 wt. % and the ratio of naphtha to middle distillates was 0.124. When the reaction temperature was 400° C., the yield of naphtha was 13.25 wt. % and the ratio of naphtha to middle distillates was 0.316. Accordingly, as the reaction temperature increased, the proportion of naphtha in the reaction product also increased.

The catalyst deactivation rate was 1.26° C./month. If the reaction is performed in a fixed bed reactor, the reactor may be operated continuously by increasing the temperature of the reactor to compensate for the activity loss of the catalyst over the lifecycle of the catalyst. Once the catalyst's lifecycle has ended, the catalyst may be unloaded from the reactor and then regenerated for use in a subsequent reaction cycle. If the reaction is performed in a catalyst replacement type reactor, such as an ebullated-bed reactor, the activity loss of the catalyst over time may be compensated by adding fresh catalyst and withdrawing the spend catalyst from the reactor. If the reactor is operated at constant temperature, then the catalyst replacement rate may be related to the deactivation rate, such that a constant reaction temperature may be maintained.

Example 2—Conditioning a Hydrocracking Catalyst

An initial hydrocracking catalyst was contacted with a conditioning stream comprising 100 ppmw HPNA compounds. The initial hydrocracking catalyst had an activity of 10° C. above a desired target and was thus highly selective for naphtha. The conditioning stream was a recycle stream from a hydrocracking process. The initial hydrocracking catalyst was contacted with the conditioning stream for 12 days and the activity of the conditioned hydrocracking catalyst was reduced by 10° C. relative to the initial hydrocracking catalyst. Additionally, the selectivity of the conditioned hydrocracking catalyst for middle distillates was improved relative to the selectivity of the initial hydrocracking catalyst for middle distillates.

Generally, the catalyst deactivation rate is from 1° C./month to 1.5° C./month. For example, in Example 1, the catalyst deactivation rate was 1.26° C./month. Accordingly, conditioning the hydrocracking catalyst of Example 2 such that the activity was reduced by 10° C. decreased the cycle length of the catalyst by from 6 to 10 months.

Additionally, for the conditioned hydrocracking catalyst of Example 2 to achieve the same overall conversion as the initial hydrocracking catalyst, the reaction using the conditioned hydrocracking catalyst would occur at a temperature 10° C. greater than the reaction temperature using the initial hydrocracking catalyst. As shown in Table 2 of Example 1, as the reaction temperature is increased, the yield of naphtha increases along with the ratio of naphtha to middle distillates. Since the conditioned catalyst would require a greater reaction temperature, one would expect a greater yield of naphtha. However, the conditioned hydrocracking catalyst of Example 2 exhibited greater yield of middle distillates. This may be due to the HPNA compounds adsorbed onto the acid sites of the catalyst preventing the over-cracking of middle distillates to naphtha. Accordingly, the conditioning step improved the selectivity of the hydrocracking catalyst for middle distillates at the expense of catalyst lifecycle.

Aspect 1. A method for hydrocracking a hydrocarbon feed, the method comprising contacting an initial catalyst with a conditioning stream comprising from 50 ppmw to 5000 ppmw heavy polynuclear aromatic compounds to form a conditioned catalyst. The initial catalyst comprises a zeolite, an amorphous silica-alumina, or both. The method comprises contacting the conditioned catalyst with the hydrocarbon feed in the presence of hydrogen to crack all or a portion of the hydrocarbon feed to form a hydrocarbon product. The hydrocarbon feed has an initial boiling point greater than or equal to 325° C.

Aspect 2. The method of aspect 1, wherein from 50 vol. % to 80 vol. % of the hydrocarbon product boils at a temperature from 170° C. to 370° C.

Aspect 3. The method of aspect 1 or aspect 2, wherein the hydrocarbon feed does not contact the initial catalyst or the conditioned catalyst during the contacting of the initial catalyst with the conditioning stream to form the conditioned catalyst.

Aspect 4. The method of any one of aspects 1 to 3, wherein the initial catalyst comprises acid sites, and wherein at least a portion of the heavy polynuclear aromatic compounds adsorb onto the acid sites of the initial catalyst.

Aspect 5. The method of any one of aspects 1 to 4, further comprising separating the hydrocarbon product into at least a first stream having an initial boiling point from 170° C. to 220° C. and a final boiling point from 320° C. to 370° C., and the conditioning stream.

Aspect 6. The method of any one of aspects 1 to 5, further comprising after contacting the initial catalyst with the conditioning stream, removing at least a portion of the heavy polynuclear aromatic compounds from the conditioning stream to form a recycle stream, and contacting the recycle stream with the conditioned catalyst and the hydrocarbon feed in the presence of hydrogen to crack all or a portion the recycle stream.

Aspect 7. The method of any one of aspects 1 to 6, wherein the initial catalyst comprises a zeolite having a FAU framework, an MFI framework, a BEA framework, or a MOR framework.

Aspect 8. The method of any one of aspects 1 to 7, wherein the initial catalyst comprises one or more of palladium, platinum, nickel, molybdenum, cobalt and tungsten.

Aspect 9. The method of any one of aspects 1 to 8, wherein an activity of the conditioned catalyst is at least 1° C. less than the activity of the initial catalyst.

Aspect 10. The method of any one of aspects 1 to 9, wherein an activity of the conditioned catalyst is reduced at a rate of 0.1° C. to 2° C. per day per 100 ppmw of heavy polynuclear aromatic compounds in the conditioning stream, relative to the initial catalyst, during the contacting of the initial catalyst with the conditioning stream.

Aspect 11. The method of any one of aspects 1 to 10, wherein contacting the initial catalyst with the conditioning stream occurs at a temperature from 300° C. to 450° C.

Aspect 12. The method of any one of aspects 1 to 11, wherein contacting the initial catalyst with the conditioning stream occurs at a pressure from 40 bar to 200 bar.

Aspect 13. The method of any one of aspects 1 to 12, wherein the initial catalyst and the conditioning stream are contacted in a reactor at a liquid hourly space velocity from 0.1 $h^{-1}$ to 10 $h^{-1}$.

Aspect 14. The method of any one of aspects 1 to 13, wherein contacting the conditioned catalyst with the hydrocarbon feed in the presence of hydrogen occurs at a temperature from 300° C. to 450° C.

Aspect 15. The method of any one of aspects 1 to 14, wherein contacting the conditioned catalyst with the hydrocarbon feed in the presence of hydrogen occurs at a pressure from 40 bar to 200 bar.

Aspect 16. The method of any one of aspects 1 to 15, wherein contacting the conditioned catalyst with the hydrocarbon feed in the presence of hydrogen occurs in a reactor at a liquid hourly space velocity from 0.1 $h^{-1}$ to 10 $h^{-1}$.

Aspect 17. The method of any one of aspects 1 to 16, wherein a ratio of hydrogen to hydrocarbon feed is from 500 to 2500 standard liters of hydrogen per liter of hydrocarbon feed.

Aspect 18. The method of any one of aspects 1 to 17, wherein the hydrocarbon feed comprises less than 50 ppmw heavy polynuclear aromatic compounds.

Aspect 19. The method of any one of aspects 1 to 18, wherein the hydrocarbon feed has an initial boiling point from 325° C. to 400° C. and a final boiling point from 565° C. to 380° C.

Aspect 20. The method of any one of aspects 1 to 19, wherein the conditioning stream has an initial boiling point from 340° C. to 370° C. and a final boiling point from 700° C. to 750° C.

The subject matter of the present disclosure has been described in detail and by reference to specific embodiments. It should be understood that any detailed description of a component or feature of an embodiment does not necessarily imply that the component or feature is essential to the particular embodiment or to any other embodiment. Further, it should be apparent to those skilled in the art that various modifications and variations can be made to the described embodiments without departing from the spirit and scope of the claimed subject matter.

For the purposes of describing and defining the present disclosure it is noted that the terms "about" or "approximately" are utilized in this disclosure to represent the inherent degree of uncertainty that may be attributed to any quantitative comparison, value, measurement, or other representation. The terms "about" and/or "approximately" are also utilized in this disclosure to represent the degree by which a quantitative representation may vary from a stated reference without resulting in a change in the basic function of the subject matter at issue.

It is noted that one or more of the following claims utilize the term "wherein" as a transitional phrase. For the purposes of defining the present technology, it is noted that this term is introduced in the claims as an open-ended transitional phrase that is used to introduce a recitation of a series of characteristics of the structure and should be interpreted in like manner as the more commonly used open-ended preamble term "comprising."

It should be understood that where a first component is described as "comprising" a second component, it is contemplated that, in some embodiments, the first component "consists" or "consists essentially of" that second component. It should further be understood that where a first component is described as "comprising" a second component, it is contemplated that, in some embodiments, the first component comprises at least 10%, at least 20%, at least 30%, at least 40%, at least 50%, at least 60%, at least 70%, at least 80%, at least 90%, at least 95%, or even at least 99% that second component (where % can be weight % or molar %).

The transitional phrases "consisting of" and "consisting essentially of" may be interpreted to be subsets of the open-ended transitional phrases, such as "comprising" and "including," such that any use of an open ended phrase to introduce a recitation of a series of elements, components, materials, or steps should be interpreted to also disclose recitation of the series of elements, components, materials, or steps using the closed terms "consisting of" and "consisting essentially of." For example, the recitation of a composition "comprising" components A, B, and C should be interpreted as also disclosing a composition "consisting of" components A, B, and C as well as a composition "consisting essentially of" components A, B, and C.

For the purposes of describing and defining the present inventive technology it is noted that the terms "substantially" and "about" are utilized herein to represent the inherent degree of uncertainty that may be attributed to any quantitative comparison, value, measurement, or other representation. The terms "substantially" and "about" are also utilized herein to represent the degree by which a quantitative representation may vary from a stated reference without resulting in a change in the basic function of the subject matter at issue.

It should further be understood that streams may be named for the components of the stream, and the component for which the stream is named may be the major component of the stream (such as comprising from 50 weight percent (wt. %), from 70 wt. %, from 90 wt. %, from 95 wt. %, from 99 wt. %, from 99.5 wt. %, or even from 99.9 wt. % of the contents of the stream to 100 wt. % of the contents of the stream). It should also be understood that components of a stream are disclosed as passing from one system component to another when a stream comprising that component is disclosed as passing from that system component to another. For example, a disclosed "propylene stream" passing from a first system component to a second system component should be understood to equivalently disclose "propylene" passing from a first system component to a second system component, and the like.

It should be understood that any two quantitative values assigned to a property may constitute a range of that property, and all combinations of ranges formed from all stated quantitative values of a given property are contemplated in this disclosure. It should be appreciated that compositional ranges of a chemical constituent in a stream or in a reactor should be appreciated as containing, in some embodiments, a mixture of isomers of that constituent.

What is claimed is:

1. A method for hydrocracking a hydrocarbon feed, the method comprising:

contacting an initial catalyst with a conditioning stream comprising from 50 ppmw to 5000 ppmw heavy polynuclear aromatic compounds to form a conditioned catalyst, wherein the initial catalyst comprises a zeolite, an amorphous silica-alumina, or both; and contacting the conditioned catalyst with the hydrocarbon feed in the presence of hydrogen to crack all or a portion of the hydrocarbon feed to form a hydrocarbon product, wherein the hydrocarbon feed has an initial boiling point greater than or equal to 325° C.

2. The method of claim 1, wherein from 50 vol. % to 80 vol. % of the hydrocarbon product boils at a temperature from 170° C. to 370° C.

3. The method of claim 1, wherein the hydrocarbon feed does not contact the initial catalyst or the conditioned catalyst during the contacting of the initial catalyst with the conditioning stream to form the conditioned catalyst.

4. The method of claim 1, wherein the initial catalyst comprises acid sites, and wherein at least a portion of the heavy polynuclear aromatic compounds adsorb onto the acid sites of the initial catalyst.

5. The method of claim 1, further comprising separating the hydrocarbon product into at least:

a first stream having an initial boiling point from 170° C. to 220° C. and a final boiling point from 320° C. to 370° C.; and the conditioning stream.

6. The method of claim 1, further comprising:

after contacting the initial catalyst with the conditioning stream, removing at least a portion of the heavy polynuclear aromatic compounds from the conditioning stream to form a recycle stream; and contacting the recycle stream with the conditioned catalyst and the hydrocarbon feed in the presence of hydrogen to crack all or a portion the recycle stream.

7. The method of claim 1, wherein the initial catalyst comprises a zeolite having a FAU framework, an MFI framework, a BEA framework, or a MOR framework.

8. The method of claim 1, wherein the initial catalyst comprises one or more of palladium, platinum, nickel, molybdenum, cobalt and tungsten.

9. The method of claim 1, wherein an activity of the conditioned catalyst is at least 1° C. less than the activity of the initial catalyst.

10. The method of claim 1, wherein an activity of the conditioned catalyst is reduced at a rate of 0.1° C. to 2° C. per day per 100 ppmw of heavy polynuclear aromatic compounds in the conditioning stream, relative to the initial catalyst, during the contacting of the initial catalyst with the conditioning stream.

11. The method of claim 1, wherein contacting the initial catalyst with the conditioning stream occurs at a temperature from 300° C. to 450° C.

12. The method of claim 1, wherein contacting the initial catalyst with the conditioning stream occurs at a pressure from 40 bar to 200 bar.

13. The method of claim 1, wherein the initial catalyst and the conditioning stream are contacted in a reactor at a liquid hourly space velocity from 0.1 $h^{-1}$ to 10 $h^{-1}$.

14. The method of claim 1, wherein contacting the conditioned catalyst with the hydrocarbon feed in the presence of hydrogen occurs at a temperature from 300° C. to 450° C.

15. The method of claim 1, wherein contacting the conditioned catalyst with the hydrocarbon feed in the presence of hydrogen occurs at a pressure from 40 bar to 200 bar.

16. The method of claim 1, wherein contacting the conditioned catalyst with the hydrocarbon feed in the presence of hydrogen occurs in a reactor at a liquid hourly space velocity from 0.1 $h^{-1}$ to 10 $h^{-1}$.

17. The method of claim 1, wherein a ratio of hydrogen to hydrocarbon feed is from 500 to 2500 standard liters of hydrogen per liter of hydrocarbon feed.

18. The method of claim 1, wherein the hydrocarbon feed comprises less than 50 ppmw heavy polynuclear aromatic compounds.

19. The method of claim 1, wherein the hydrocarbon feed has an initial boiling point from 325° C. to 400° C. and a final boiling point from 565° C. to 380° C.

20. The method of claim 1, wherein the conditioning stream has an initial boiling point from 340° C. to 370° C. and a final boiling point from 700° C. to 750° C.

* * * * *